US009261845B2

(12) United States Patent
Ichihashi

(10) Patent No.: US 9,261,845 B2
(45) Date of Patent: Feb. 16, 2016

(54) IMAGE FORMING SYSTEM, CONTROL APPARATUS, AND CONTROL METHOD

(71) Applicant: Kenta Ichihashi, Kanagawa (JP)

(72) Inventor: Kenta Ichihashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/468,284

(22) Filed: Aug. 25, 2014

(65) Prior Publication Data

US 2015/0071674 A1 Mar. 12, 2015

(30) Foreign Application Priority Data

Sep. 6, 2013 (JP) ..... 2013-185578

(51) Int. Cl.
*G03G 15/00* (2006.01)

(52) U.S. Cl.
CPC ..... *G03G 15/6582* (2013.01)

(58) Field of Classification Search
CPC ..... G03G 15/6582
See application file for complete search history.

(56) References Cited

U.S. PATENT DOCUMENTS

2010/0070657 A1 3/2010 Yoshida
2014/0042694 A1* 2/2014 Konishi ..... 271/279

FOREIGN PATENT DOCUMENTS

JP 2008-213413 9/2008
JP 2010-067148 3/2010

* cited by examiner

*Primary Examiner* — Sandra Brase
(74) *Attorney, Agent, or Firm* — Duft Bornsen & Fettig LLP

(57) ABSTRACT

An image forming system includes an image forming unit, a post-processing unit, an acquiring unit, a first transmitting unit, and a post-processing control unit. The image forming unit forms an image on a recording medium. The post-processing unit is provided at a side for discharging the recording medium of the image forming unit and performs predetermined post-processing on the recording medium. The acquiring unit acquires a discharge timing at which the recording medium is discharged from the image forming unit. The first transmitting unit transmits a post-processing start signal corresponding to the discharge timing. The post-processing control unit causes the post-processing unit to start the post-processing when receiving the post-processing start signal from the first transmitting unit.

11 Claims, 8 Drawing Sheets

IMAGE FORMING SYSTEM, CONTROL APPARATUS, AND CONTROL METHOD

CROSS-REFERENCE TO RELATED APPLICATIONS

The present application claims priority to and incorporates by reference the entire contents of Japanese Patent Application No. 2013-185578 filed in Japan on Sep. 6, 2013.

BACKGROUND OF THE INVENTION

1. Field of the Invention

The present invention relates to an image forming system, a control apparatus, and a control method.

2. Description of the Related Art

Recently, image forming apparatuses are used in combination with post-processing apparatuses having functions of folding, punching, sorting, cutting, and stapling, for example. Specifically, such apparatuses are arranged in order of performing processing on a recording medium in advance. The recording medium is conveyed from an apparatus provided to the upstream in the conveying direction of the recording medium to an apparatus provided to the downstream in the conveying direction while being sequentially subjected to the processing.

Such image forming apparatuses and post-processing apparatuses each may have a communication rule and a control rule varying depending on the manufacturer of each apparatus, for example. Even if these apparatuses are directly connected, it is difficult to cause them to operate in conjunction with each other and perform a series of operations of image formation and post-processing.

Furthermore, as a method for controlling such apparatuses, there has been disclosed a technology for controlling an image forming device and peripherals, such as a post-processing device, by one driver installed in a main controller (refer to Japanese Patent Application Laid-open No. 2010-067148, for example). The method described in Japanese Patent Application Laid-open No. 2010-067148 displays a list of image forming devices capable of executing all the settings designated by the driver installed in the main controller. The method then causes a user to select one image forming device from which print data is to be output from the image forming devices in the list. This makes it possible to control each peripheral using one driver without limiting the operation of each peripheral.

The conventional technology can collectively control each of the peripherals, such as an image forming device and a post-processing device. However, it is difficult for the conventional technology to cause an image forming unit that forms an image and a post-processing unit that performs post-processing to operate in conjunction with each other.

Therefore, there is a need for an image forming system, a control apparatus, and a control method that enable an image forming unit and a post-processing unit to operate in conjunction with each other.

SUMMARY OF THE INVENTION

According to an embodiment, an image forming system includes an image forming unit, a post-processing unit, an acquiring unit, a first transmitting unit, and a post-processing control unit. The image forming unit forms an image on a recording medium. The post-processing unit is provided at a side for discharging the recording medium of the image forming unit and performs predetermined post-processing on the recording medium. The acquiring unit acquires a discharge timing at which the recording medium is discharged from the image forming unit. The first transmitting unit transmits a post-processing start signal corresponding to the discharge timing. The post-processing control unit causes the post-processing unit to start the post-processing when receiving the post-processing start signal from the first transmitting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image forming system, a control apparatus, a control method, and a computer program according to the present invention are described below in greater detail with reference to the accompanying drawings.

First Embodiment

Figure 1:
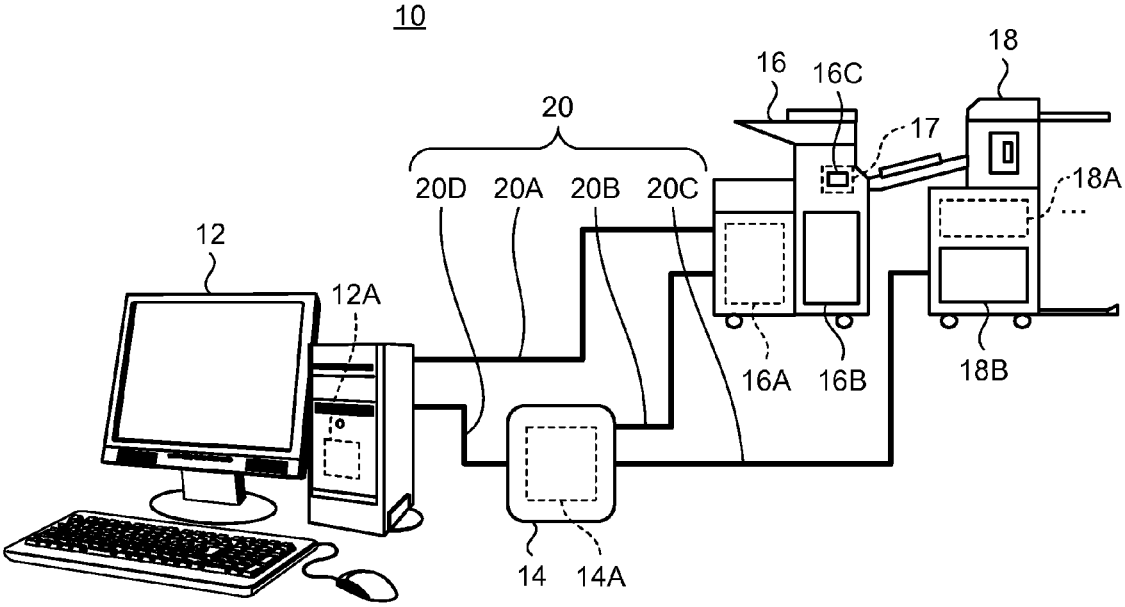
FIG. 1 is a schematic of an image forming system according to an embodiment of the present invention.

FIG. 1 is a schematic of an image forming system 10 according to an embodiment of the present invention. The image forming system 10 according to the present embodiment includes an information processing apparatus 12, a control apparatus 14, an image forming apparatus 16, and a post-processing apparatus 18.

The information processing apparatus 12 and the image forming apparatus 16 are connected in a manner capable of transmitting and receiving signals via a communication unit 20A. The information processing apparatus 12 and the control apparatus 14 are connected in a manner capable of transmitting and receiving signals via a communication unit 20D. The control apparatus 14 and the image forming apparatus 16 are connected in a manner capable of transmitting and receiving signals via a communication unit 20B. The control apparatus 14 and the post-processing apparatus 18 are connected in a manner capable of transmitting and receiving signals via a communication unit 20C. The communication units 20A to 20D may be collectively referred to as a communication unit 20 in the description below.

The communication unit 20 is a wired or wireless communication line. The communication unit 20 may be a dedicated communication line or a network.

The image forming apparatus 16 forms an image on a recording medium. The image forming apparatus 16 includes a control unit 16A, an image forming unit 16B, and a detecting unit 16C.

The image forming unit 16B includes a known mechanism that conveys a recording medium and forms an image of image data included in print data acquired from the information processing apparatus 12 on the recording medium. While examples of the known mechanism include a known electrophotography image forming mechanism and a known ink-jet image forming mechanism, it is not limited thereto. The recording medium on which the image is formed by the image forming unit 16B is conveyed by a conveying mechanism, which is not illustrated, included in the image forming unit 16B and is discharged to the outside of the image forming apparatus 16.

The control unit 16A is a computer including a central processing unit (CPU), a read only memory (ROM), and a random access memory (RAM) and controls the image forming unit 16B. The control unit 16A controls the image forming unit 16B so as to perform the following series of operation: sequentially conveying recording media accommodated in advance in the image forming apparatus 16, forming an image on each recording medium, and discharging the recording medium on which the image is formed to the outside of the image forming apparatus 16. Because the series of operation of image formation is a known technology, an explanation thereof is omitted.

The detecting unit 16C is provided to a discharge area 17 in the image forming apparatus 16. The discharge area 17 is an area in the image forming apparatus 16 where the recording medium on which the image is formed by the image forming unit 16B is discharged to the outside of the image forming apparatus 16.

In the present embodiment, the discharge area 17 is an area where the leading end on the downstream in the conveying direction of the recording medium on which the image is formed by the image forming unit 16B reaches a boundary between the outside and the inside separated by the housing of the image forming apparatus 16. The discharge area 17 may be any area on the path to discharge the recording medium on which the image is formed by the image forming unit 16B from the image forming unit 16B to the outside of the image forming apparatus 16. To achieve an efficient cooperation in the image forming system 10, the discharge area 17 is preferably an area corresponding to the boundary. In other words, the detecting unit 16C is preferably arranged at the area.

The detecting unit 16C is a known sensor that can detect a recording medium. When detecting a recording medium, the detecting unit 16C transmits a detection signal indicating detection of the recording medium to the control apparatus 14. In other words, when the detecting unit 16C detects the recording medium and transmits the detection signal, the recording medium is positioned at the discharge area 17 of the image forming apparatus 16.

The post-processing apparatus 18 is provided at the side for discharging the recording medium of the image forming apparatus 16. The post-processing apparatus 18 is connected to the control apparatus 14 via the communication unit 20C. The post-processing apparatus 18 is further connected to the image forming apparatus 16 via the communication unit 20C, the control apparatus 14, and the communication unit 20B. The post-processing apparatus 18 is further connected to the information processing apparatus 12 via the communication unit 20C, the control apparatus 14, and the communication unit 20D.

The post-processing apparatus 18 includes a conveying mechanism, which is not illustrated. The post-processing apparatus 18 receives and conveys the recording medium discharged from the image forming apparatus 16 and performs predetermined post-processing. The post-processing apparatus 18 includes a control unit 18A and a post-processing unit 18B. The post-processing unit 18B conveys the recording medium discharged from the image forming apparatus 16 and performs the predetermined post-processing on the recording medium. The control unit 18A is a computer including a CPU, a ROM, and a RAM and controls the post-processing unit 18B.

The post-processing is various types of processing performed on the recording medium on which the image is formed by the image forming apparatus 16. While specific examples of the post-processing include folding to fold the recording medium in a Z-fold and a half-fold, binding to perform ring binding and case binding, cutting to cut the recording medium, punching to bore a punch hole in the recording medium, and stapling, the post-processing is not limited thereto.

The present embodiment describes an example in which the post-processing unit 18B includes a mechanism that performs folding on the recording medium. The post-processing performed by the post-processing unit 18B is not limited to folding and may be one or a combination of a plurality of the post-processing described above.

The control apparatus 14 performs control to cause the image forming apparatus 16 and the post-processing apparatus 18 to operate (i.e., "cooperate") in conjunction with each other. The control apparatus 14 includes a control processing unit 14A. The control processing unit 14A is a computer including a CPU and performs each processing, which will be described later.

The information processing apparatus 12 is a computer including a CPU, a ROM, and a RAM. The information processing apparatus 12 transmits print data to the image forming apparatus 16. The information processing apparatus 12 also transmits processing information including the contents of post-processing of the post-processing apparatus 18 to the control apparatus 14. These data are transmitted to the control apparatus 14 and the image forming apparatus 16 by a user operating a keyboard or the like provided to the information processing apparatus 12 to issue an instruction, for example.

The print data includes image formation information on formation of an image to be formed. The image formation information is required by the image forming apparatus 16 to perform image formation processing. Specifically, the image formation information includes image data of an image to be formed, the resolution of the image, the number of pages, the number of colors (the number of colors of the image to be formed), a print mode, and the size of a recording medium on which the image is to be formed, for example.

The processing information includes the contents of post-processing to be performed by the post-processing apparatus 18 (specifically, the post-processing unit 18B). The contents of post-processing are required by the post-processing apparatus 18 to perform post-processing. In the case of the post-processing apparatus 18 performing folding on the recording medium, the contents of post-processing include the size of the recording medium and the type of folding, for example.

Figure 2:
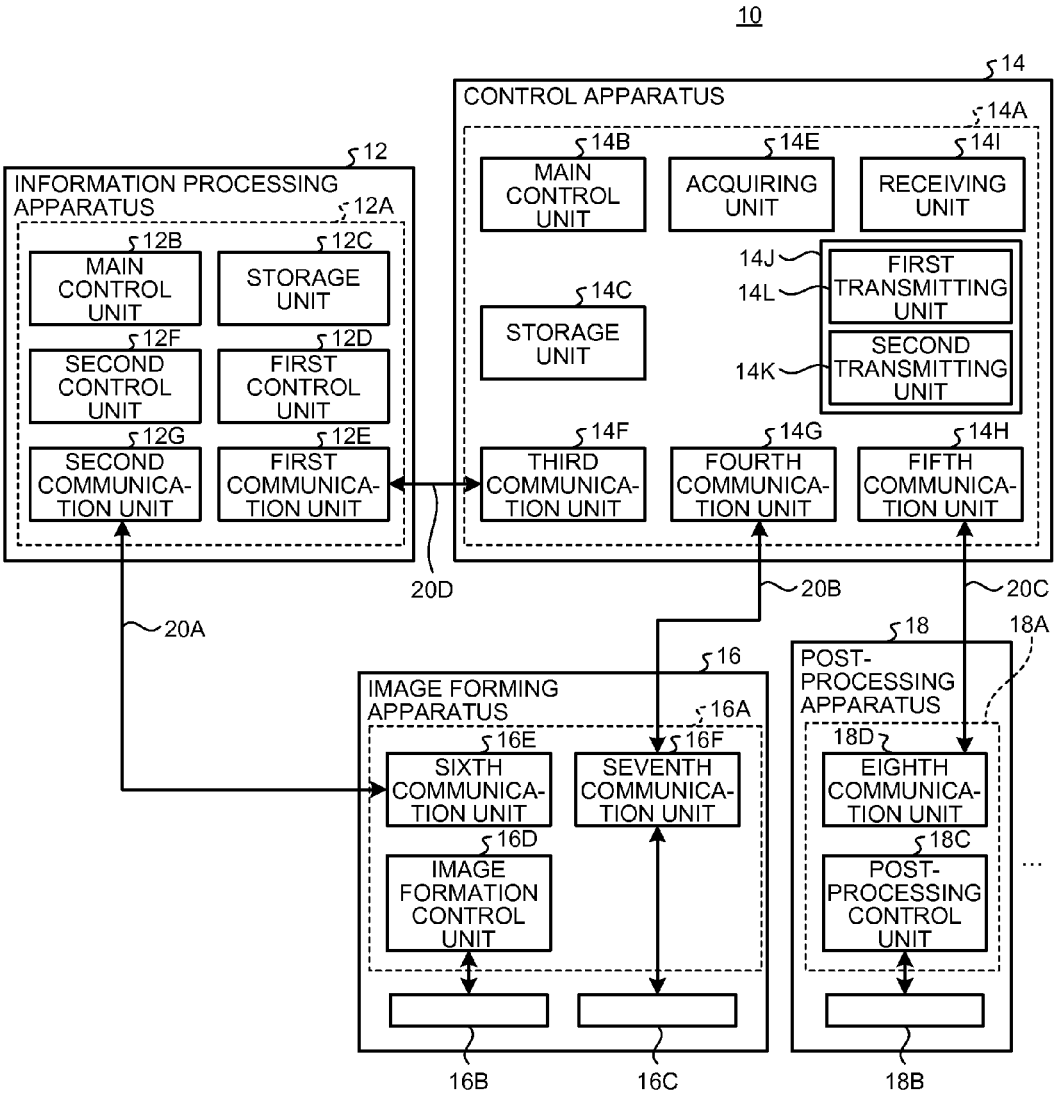
FIG. 2 is a functional block diagram of an image forming system according to a first embodiment of the present invention.

The following describes functions of the image forming system 10. FIG. 2 is a functional block diagram of the image forming system 10.

An information processing unit 12A of the information processing apparatus 12 includes a main control unit 12B, a storage unit 12C, a first control unit 12D, a first communication unit 12E, a second control unit 12F, and a second communication unit 12G. The main control unit 12B, the storage unit 12C, the first control unit 12D, the first communication unit 12E, the second control unit 12F, and the second communication unit 12G may be implemented by a processor such as a CPU executing a computer program, that is, by software, by hardware such as an integrated circuit (IC), or by a combination of software and hardware.

The main control unit 12B collectively controls the information processing unit 12A. The storage unit 12C stores therein various types of data.

The first control unit 12D controls the control apparatus 14. In the case of the first control unit 12D being implemented by software, the first control unit 12D is implemented by the processor such as a CPU executing driver software that connects to the control apparatus 14 and controls the control apparatus 14.

The first communication unit 12E transmits and receives various types of signals and data to and from the control apparatus 14. The first control unit 12D controls the control apparatus 14 via the first communication unit 12E. In the present embodiment, the first control unit 12D transmits processing information including the contents of post-processing of the post-processing apparatus 18 to the control apparatus 14 via the first communication unit 12E.

The second control unit 12F controls the image forming apparatus 16. The second control unit 12F converts image data to be formed into data in a format executable by the image forming apparatus 16 and creates image formation information including the image data resulting from conversion, the resolution in printing, and page information. The second control unit 12F transmits print data including the image formation information to the image forming apparatus 16 via the second communication unit 12G.

In the case of the second control unit 12F being implemented by software, the second control unit 12F is implemented by the processor such as a CPU executing driver software such as a printer driver that connects to the image forming apparatus 16 and controls the image forming apparatus 16.

The second communication unit 12G transmits and receives various types of signals and data to and from the image forming apparatus 16. The second control unit 12F transmits the print data and other data to the image forming apparatus 16 via the second communication unit 12G.

The control processing unit 14A of the control apparatus 14 includes a main control unit 14B, a storage unit 14C, an acquiring unit 14E, a third communication unit 14F, a fourth communication unit 14G, a fifth communication unit 14H, a receiving unit 14I, and a transmitting unit 14J. The main control unit 14B, the storage unit 14C, the acquiring unit 14E, the third communication unit 14F, the fourth communication unit 14G, the fifth communication unit 14H, the receiving unit 14I, and the transmitting unit 14J may be implemented by a processor such as a CPU executing a computer program, that is, by software, by hardware such as an IC, or by a combination of software and hardware.

The main control unit 14B collectively controls the control processing unit 14A. The storage unit 14C stores therein various types of data.

The acquiring unit 14E acquires a discharge timing at which a recording medium is discharged from the image forming unit 16B. In the present embodiment, the acquiring unit 14E receives a detection signal from the detecting unit 16C provided to the image forming apparatus 16 and acquires the detection signal as the discharge timing. The fourth communication unit 14G transmits and receives data and signals to and from the image forming apparatus 16. In other words, the acquiring unit 14E receives the detection signal from the detecting unit 16C via the communication unit 20B and the fourth communication unit 14G.

The third communication unit 14F transmits and receives data and signals to and from the information processing apparatus 12. The third communication unit 14F transmits and receives the data and signals to and from the information processing apparatus 12 via the communication unit 20D. In the present embodiment, the third communication unit 14F receives the processing information from the information processing apparatus 12. When receiving a processing completion signal indicating completion of post-processing from the post-processing apparatus 18, the third communication unit 14F transmits processing completion notification to the information processing apparatus 12.

The fourth communication unit 14G transmits and receives data and signals to and from the image forming apparatus 16 via the communication unit 20B. The fifth communication unit 14H transmits and receives data and signals to and from the post-processing apparatus 18 via the communication unit 20C.

The receiving unit 14I receives the processing information including the contents of post-processing to be performed by the post-processing unit 18B of the post-processing apparatus 18 from the information processing apparatus 12.

The transmitting unit 14J transmits various types of data and signals to the post-processing apparatus 18 via the fifth communication unit 14H. The transmitting unit 14J includes a second transmitting unit 14K and a first transmitting unit 14L. The second transmitting unit 14K transmits the processing information received from the information processing apparatus 12 to the post-processing apparatus 18.

When the acquiring unit 14E acquires a detection signal as the discharge timing, the first transmitting unit 14L transmits a post-processing start signal indicating start of a post-processing operation to the post-processing apparatus 18. The present embodiment adjusts in advance the set position of the detecting unit 16C, data transmission speed of the communication unit 20, and other factors as follows: a first time from when a recording medium is detected by the detecting unit 16C to when the recording medium reaches a sheet insertion port, which is not illustrated, in the post-processing unit 18B is equal to a second time from when the acquiring unit 14E acquires a discharge timing and the first transmitting unit 14L transmits a post-processing start signal to when a post-processing control unit 18C receives the post-processing start signal and the post-processing unit 18B starts post-processing. When the recording medium reaches the sheet insertion port of the post-processing apparatus 18, the post-processing apparatus 18 becomes ready to sequentially convey the recording medium and start the post-processing.

If the first time and the second time are different from each other, the first transmitting unit 14L calculates difference between the first time and the second time and stores the difference in the storage unit 14C in advance. The apparatus configuration, the transmission speed, and other factors are adjusted in advance such that the second time is at least equal to or longer than the first time. In this case, the first transmitting unit 14L simply needs to transmit the post-processing start signal to the post-processing apparatus 18 when a time corresponding to the difference between the first time and the second time (second time−first time) has elapsed since the acquiring unit 14E acquires the detection signal as the discharge timing.

The control unit 18A of the post-processing apparatus 18 includes an eighth communication unit 18D and the post-processing control unit 18C. The eighth communication unit 18D and the post-processing control unit 18C may be implemented by a processor such as a CPU executing a computer program, that is, by software, by hardware such as an IC, or by a combination of software and hardware.

The eighth communication unit 18D transmits and receives data and signals to and from the control apparatus 14 via the communication unit 20C. The post-processing control unit 18C controls the post-processing unit 18B so as to perform the post-processing specified by the contents of post-processing included in the processing information received from the control apparatus 14 via the eighth communication unit 18D. The post-processing control unit 18C controls the post-processing unit 18B so as to start the post-processing when receiving the post-processing start signal indicating start of the post-processing operation from the control apparatus 14 via the eighth communication unit 18D and the communication unit 20C. Thus, the post-processing unit 18B starts to convey the recording medium and perform the post-processing in response to reception of the post-processing start signal from the control apparatus 14 by the post-processing control unit 18C.

The control unit 16A of the image forming apparatus 16 includes a sixth communication unit 16E, a seventh communication unit 16F, and an image formation control unit 16D. The sixth communication unit 16E, the seventh communication unit 16F, and the image formation control unit 16D may be implemented by a processor such as a CPU executing a computer program, that is, by software, by hardware such as an IC, or by a combination of software and hardware.

The sixth communication unit 16E transmits and receives data and signals to and from the information processing apparatus 12 via the communication unit 20A. The seventh communication unit 16F transmits and receives data and signals to and from the control apparatus 14 via the communication unit 20B. The seventh communication unit 16F is connected to the detecting unit 16C. The detecting unit 16C transmits the detection signal of the recording medium to the control apparatus 14 via the seventh communication unit 16F and the communication unit 20B.

The image formation control unit 16D controls conveyance of the recording medium and image formation performed by the image forming unit 16B. The image formation control unit 16D controls the image forming unit 16B so as to form an image on the recording medium based on the image formation information included in the print data received from the information processing apparatus 12. The image formation control unit 16D, for example, controls the image forming unit 16B with a known method for performing conveyance of a recording medium and image formation processing as follows: an image of image data included in the image formation information is formed on a recording medium of the size specified by the size of the recording medium included in the image formation information with the resolution and the number of colors included in the image formation information.

The following describes a sequence of cooperation processing performed in the image forming system 10, so as to cause the image forming apparatus 16 and the post-processing apparatus 18 to operate (i.e., "cooperate") in conjunction with each other.

Figure 3:
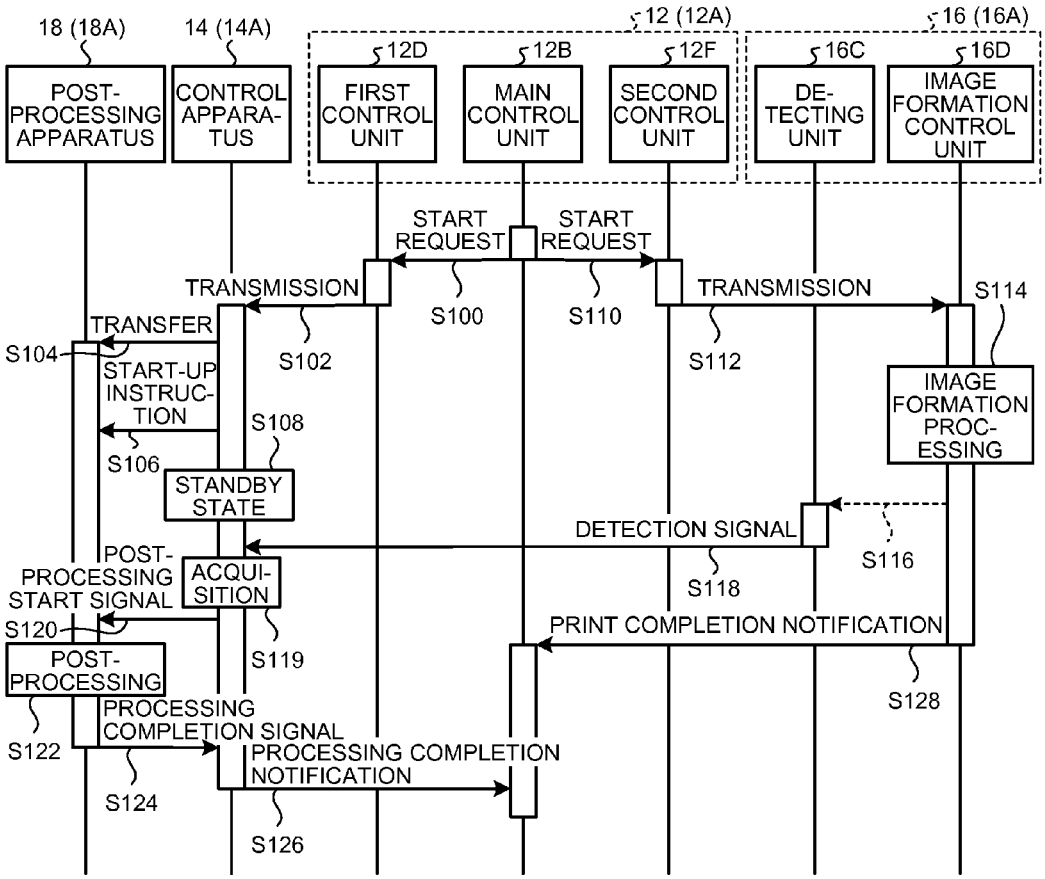
FIG. 3 is a sequence diagram of an example of cooperation processing performed in the image forming system according to the first embodiment.

FIG. 3 is a sequence diagram of an example of the cooperation processing performed in the image forming system 10.

The main control unit 12B of the information processing unit 12A transmits a start request indicating start of processing to the first control unit 12D and the second control unit 12F (Step S100 and Step S110). The main control unit 12B transmits the start request to the first control unit 12D and the second control unit 12F when receiving a signal indicating a start instruction of the cooperation processing from an operating unit such as a keyboard, which is not illustrated, of the information processing apparatus 12, for example. The signal indicating the start instruction is input to the main control unit 12B when the user operates a predetermined key on the operating unit of the information processing apparatus 12, for example. The main control unit 12B transmits the start request to the first control unit 12D and the second control unit 12F when receiving the signal indicating the start instruction.

The first control unit 12D that receives the start request from the main control unit 12B transmits processing information to the control apparatus 14 (control processing unit 14A) (Step S102). The contents of post-processing of the post-processing apparatus 18 included in the processing information may be set by the user operating the operating unit, which is not illustrated, of the information processing apparatus 12 to issue an instruction before the start of the cooperation processing, for example. The preset contents of post-processing to be performed by the post-processing apparatus 18 may be stored in the storage unit 12C in advance. The first control unit 12D may transmit the processing information by reading the contents of post-processing from the storage unit 12C. The contents of post-processing stored in the storage unit 12C can be optionally changed by the user operating the operating unit, which is not illustrated, of the information processing apparatus 12 to issue an instruction, for example.

In the control processing unit 14A, the receiving unit 14I receives the processing information, and the second transmitting unit 14K transfers the processing information to the post-processing apparatus 18 (Step S104). In the control unit 18A of the post-processing apparatus 18, the post-processing control unit 18C receives the processing information. The post-processing control unit 18C makes various types of initial settings and the like such that the post-processing unit 18B can perform the post-processing specified by the contents of processing included in the received processing information.

Subsequently, the transmitting unit 14J of the control processing unit 14A transmits a start-up instruction for bringing the post-processing apparatus 18 into a standby state capable of starting the post-processing to the post-processing apparatus 18 (Step S106). In the control unit 18A of the post-processing apparatus 18, the post-processing control unit 18C receives the start-up instruction. The post-processing control unit 18C that receives the start-up instruction brings the post-processing unit 18B into a standby state such that the post-processing unit 18B can start the post-processing when receiving the next processing start signal.

Subsequently, the control processing unit 14A goes into a standby state for waiting reception of a signal or data from the information processing apparatus 12 or the image forming apparatus 16 (Step S108). In the present embodiment, the acquiring unit 14E of the control processing unit 14A goes into a state of waiting for a detection signal from the detecting unit 16C.

By contrast, when the main control unit 12B transmits the start request to the second control unit 12F at Step S110, the second control unit 12F that receives the start request transmits print data including image formation information to the image forming apparatus 16 (Step S112). Items included in the image formation information, such as image data, the resolution of the image, the number of pages, the number of colors (the number of colors of the image to be formed), a print mode, and the size of a recording medium on which the image is to be formed, are specified by the user operating the operating unit, which is not illustrated, of the information processing apparatus 12 to issue an instruction before the start of the cooperation processing, for example. The second control unit 12F transmits the print data including the image formation information instructed by the operation performed on the operating unit by the user to the image forming apparatus 16.

In the control unit 16A of the image forming apparatus 16, the image formation control unit 16D receives the print data. The image formation control unit 16D that receives the print data performs image formation processing (Step S114). Specifically, at Step S114, the image formation control unit 16D controls the image forming unit 16B so as to form an image on a recording medium based on the image formation information included in the print data received from the information processing apparatus 12. The image formation processing at Step S114 causes the image forming unit 16B to start conveyance of the recording medium and the image formation processing for forming the image on the recording medium and then sequentially conveying the recording medium on which the image is formed to the outside of the image forming apparatus 16.

When the recording medium on which the image is formed by the image forming unit 16B is conveyed and reaches the discharge area 17 in the image formation processing at Step S114 (Step S116), the detecting unit 16C transmits a detection signal to the control apparatus 14 (Step S118).

In the control apparatus 14, the acquiring unit 14E acquires the detection signal transmitted from the detecting unit 16C (Step S119). In other words, the control processing unit 14A of the control apparatus 14 remains in the standby state adopted at Step S108 until it receives the detection signal from the detecting unit 16C of the image forming apparatus 16. When acquiring the detection signal, the control processing unit 14A releases the standby state.

If the acquiring unit 14E acquires the detection signal at Step S119, the first transmitting unit 14L in the control processing unit 14A transmits a post-processing start signal indicating start of post-processing to the post-processing apparatus 18 (Step S120).

In the control unit 18A of the post-processing apparatus 18, the post-processing control unit 18C receives the post-processing start signal. The post-processing control unit 18C controls the post-processing unit 18B so as to start the post-processing when receiving the post-processing start signal. The control causes the post-processing unit 18B to start the post-processing specified by the contents of post-processing transferred at Step S104 (Step S122).

If no recording medium is conveyed from the image forming apparatus 16 for a predetermined time or longer, the post-processing unit 18B transmits a processing completion signal indicating completion of the post-processing to the control apparatus 14 (Step S124). The predetermined time may be set in advance as a time used to determine completion of the post-processing and may be optionally changed.

The control processing unit 14A that receives the processing completion signal transmits processing completion notification indicating completion of the processing to the information processing apparatus 12 (Step S126). By contrast, if the image forming apparatus 16 that starts the image formation processing at Step S114 completes formation of all the images in the image data specified by the image formation information included in the print data transmitted from the information processing apparatus 12, the image forming apparatus 16 transmits print completion notification indicating completion of the image formation to the information processing apparatus 12 (Step S128).

If the print completion notification is received from the image forming apparatus 16 and the processing completion notification is received from the control apparatus 14, the main control unit 12B of the information processing apparatus 12 completes the cooperation processing.

As described above, the image forming system 10 according to the present embodiment transmits the post-processing start signal to the post-processing control unit 18C of the post-processing apparatus 18 when the control apparatus 14 connected to the information processing apparatus 12, the image forming apparatus 16, and the post-processing apparatus 18 acquires the detection signal of the recording medium from the detecting unit 16C provided to the discharge area 17 in the image forming apparatus 16. When receiving the post-processing start signal, the control unit 18A of the post-processing apparatus 18 performs control such that the post-processing unit 18B starts the post-processing.

In the image forming system 10 according to the present embodiment, the post-processing apparatus 18 starts the post-processing in response to the post-processing start signal received from the control processing unit 14A. This enables the image forming unit 16B and the post-processing unit 18B to operate in conjunction with each other.

First Modification

While the control processing unit 14A is included in the control apparatus 14 in the embodiment above, the control processing unit 14A may be mounted on the post-processing apparatus 18.

Second Embodiment

In an image forming system according to a second embodiment, an information processing apparatus calculates the discharge timing described above.

Figure 4:
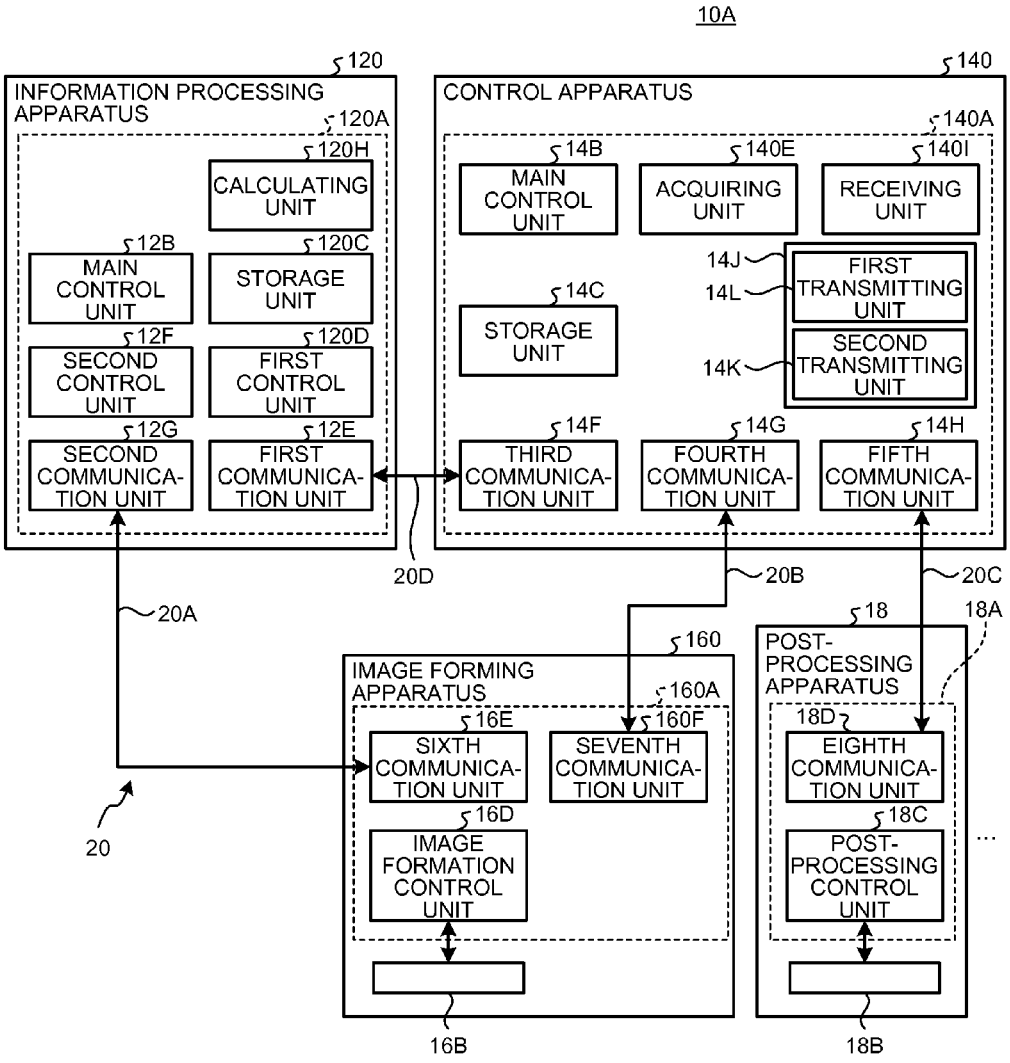
FIG. 4 is a functional block diagram of an image forming system according to a second embodiment of the present invention.

FIG. 4 is a functional block diagram of an image forming system 10A according to the present embodiment. In the image forming system 10A according to the present embodiment, an information processing apparatus 120, a control apparatus 140, an image forming apparatus 160, and a post-processing apparatus 18 are connected via a communication unit 20. The post-processing apparatus 18 and the communication unit 20 are the same as those in the first embodiment.

The information processing apparatus 120 and the control apparatus 140 are connected via a communication unit 20D. The control apparatus 140 is connected to the image forming apparatus 160 via a communication unit 20B and to the post-processing apparatus 18 via a communication unit 20C. The information processing apparatus 120 and the image forming apparatus 160 are connected via a communication unit 20A.

The information processing apparatus 120 includes an information processing unit 120A that controls the information processing apparatus 120. The information processing unit 120A includes a main control unit 12B, a storage unit 120C, a first control unit 120D, a calculating unit 120H, a first communication unit 12E, a second control unit 12F, and a second communication unit 12G. The function and the configuration of the main control unit 12B, the first communication unit 12E, the second control unit 12F, and the second communication unit 12G are the same as those in the first embodiment.

The main control unit 12B, the storage unit 120C, the first control unit 120D, the calculating unit 120H, the first communication unit 12E, the second control unit 12F, and the second communication unit 12G may be implemented by a processor such as a CPU executing a computer program, that is, by software, by hardware such as an IC, or by a combination of software and hardware.

The storage unit 120C stores therein processing capability information indicating processing capability of an image forming unit 16B of the image forming apparatus 160 in advance. The processing capability is the image formation speed in the image forming unit 16B, the conveyance speed of a recording medium in the image forming unit 16B, and the conveyance distance of the recording medium in the image forming unit 16B (distance in which the recording medium is conveyed from an accommodating unit that accommodates the recording medium to a discharge area 17). The image formation speed and the conveyance speed vary depending on the parameter specified by image formation information on formation of an image to be formed.

Thus, the storage unit 120C stores therein the image formation speed and the conveyance speed corresponding to one or a plurality of parameters, such as the resolution of the image to be formed, the number of pages, the number of colors, and the size of the recording medium on which the image is formed, specified by the image formation information and stores therein the conveyance distance in advance. Alternatively, the storage unit 120C may store therein in advance calculation equations for calculating the image formation speed and the conveyance speed corresponding to one or a plurality of parameters, such as the resolution of the image to be formed, the number of pages, the number of colors, and the size of the recording medium on which the image is formed, specified by the image formation information.

The calculating unit 120H calculates a discharge timing using the image formation information on formation of an image to be formed and the processing capability information stored in the storage unit 120C. Specifically, the calculating unit 120H calculates a time from when the recording medium on which the image is to be formed starts to be conveyed from the accommodating unit in the image forming apparatus 160 and the image to be formed is formed thereon to when the recording medium is discharged from the image forming apparatus 160 as the discharge timing using the image formation information and the processing capability information.

The first control unit 120D controls the control apparatus 140. In the case of the first control unit 120D being implemented by software, the first control unit 120D is implemented by the processor such as a CPU executing driver software that connects to the control apparatus 140 and controls the control apparatus 140. In the present embodiment, the first control unit 120D transmits processing information including the discharge timing calculated by the calculating unit 120H and the contents of post-processing to the control apparatus 140 via the first communication unit 12E and the communication unit 20D.

A control processing unit 140A of the control apparatus 140 includes a main control unit 14B, a storage unit 14C, an acquiring unit 140E, a third communication unit 14F, a fourth communication unit 14G, a fifth communication unit 14H, a receiving unit 140I, and a transmitting unit 14J. The main control unit 14B, the storage unit 14C, the acquiring unit 140E, the third communication unit 14F, the fourth communication unit 14G, the fifth communication unit 14H, the receiving unit 140I, and the transmitting unit 14J may be implemented by a processor such as a CPU executing a computer program, that is, by software, by hardware such as an IC, or by a combination of software and hardware. The main control unit 14B, the storage unit 14C, the third communication unit 14F, the fourth communication unit 14G, the fifth communication unit 14H, and the transmitting unit 14J are the same as those in the first embodiment.

The receiving unit 140I receives the processing information including the contents of post-processing to be performed by a post-processing unit 18B of the post-processing apparatus 18 and the discharge timing calculated by the calculating unit 120H of the information processing apparatus 120 from the information processing apparatus 120.

The acquiring unit 140E acquires, from the information processing apparatus 120, the discharge timing at which a recording medium is discharged from the image forming unit 16B. In the present embodiment, the acquiring unit 140E acquires the discharge timing by acquiring the discharge timing included in the processing information received by the receiving unit 140I.

The post-processing apparatus 18 includes a control unit 18A and the post-processing unit 18B. The control unit 18A includes an eighth communication unit 18D and a post-processing control unit 18C. The control unit 18A, the post-processing unit 18B, the post-processing control unit 18C, and the eighth communication unit 18D are the same as those in the first embodiment.

The image forming apparatus 160 includes a control unit 160A and the image forming unit 16B. The control unit 160A controls the image forming unit 16B. The image forming unit 16B is the same as that in the first embodiment. The control unit 160A includes a sixth communication unit 16E, a seventh communication unit 160F, and an image formation control unit 16D. The sixth communication unit 16E and the image formation control unit 16D are the same as those in the first embodiment. The seventh communication unit 160F transmits and receives data and signals to and from the control apparatus 140.

The sixth communication unit 16E, the seventh communication unit 160F, and the image formation control unit 16D may be implemented by a processor such as a CPU executing a computer program, that is, by software, by hardware such as an IC, or by a combination of software and hardware.

Figure 5:
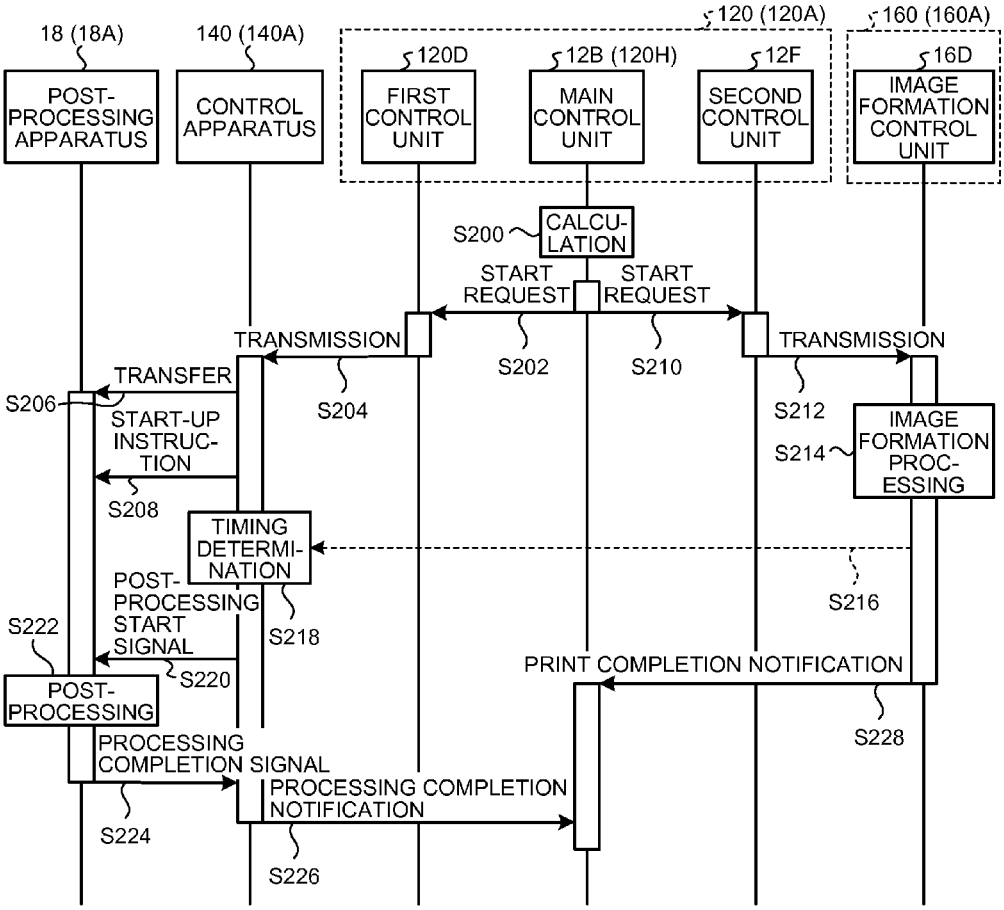
FIG. 5 is a sequence diagram of an example of cooperation processing performed in the image forming system according to the second embodiment.

The following describes a sequence of cooperation processing performed in the image forming system 10A. FIG. 5 is a sequence diagram of an example of the cooperation processing performed in the image forming system 10A.

The calculating unit 120H of the information processing unit 120A calculates a discharge timing using image formation information on formation of an image to be formed by the image forming apparatus 160 and processing capability information stored in the storage unit 120C (Step S200).

Subsequently, the main control unit 12B of the information processing unit 120A transmits a start request indicating start of processing to the first control unit 120D and the second control unit 12F (Step S202 and Step S210). The start request is the same as that in the first embodiment.

The first control unit 120D that receives the start request from the main control unit 12B transmits processing information including the contents of post-processing of the post-processing apparatus 18 and the discharge timing calculated by the calculating unit 120H at Step S200 to the control apparatus 140 (control processing unit 140A) (Step S204).

In the control processing unit 140A, the receiving unit 140I receives the processing information, and a second transmitting unit 14K transfers the processing information to the post-processing apparatus 18 (Step S206). In the control unit 18A of the post-processing apparatus 18, the post-processing control unit 18C receives the processing information. The post-processing control unit 18C makes various types of initial settings and the like such that the post-processing unit 18B can perform the post-processing specified by the contents of processing included in the received processing information.

Subsequently, the transmitting unit 14J of the control processing unit 140A transmits a start-up instruction for bringing the post-processing apparatus 18 into a standby state capable of starting the post-processing to the post-processing apparatus 18 (Step S208). In the control unit 18A of the post-processing apparatus 18, the post-processing control unit 18C receives the start-up instruction. The post-processing control unit 18C that receives the start-up instruction brings the post-processing unit 18B into a standby state such that the post-processing unit 18B can start the post-processing when receiving the next processing start signal.

By contrast, when the main control unit 12B transmits the start request to the second control unit 12F at Step S210, the second control unit 12F that receives the start request transmits print data including the image formation information to the image forming apparatus 160 (Step S212).

In the control unit 160A of the image forming apparatus 160, the image formation control unit 16D receives the print data. The image formation control unit 16D that receives the print data performs image formation processing (Step S214). The processing at Step S214 is the same as the image formation processing in the first embodiment (refer to Step S114 in FIG. 3).

Subsequently, a first transmitting unit 14L of the control processing unit 140A determines a discharge timing (Step S218). The first transmitting unit 14L determines a timing (Step S216) at which a recording medium on which the image is formed by the image forming unit 16B is conveyed to the discharge area 17 in the image formation processing at Step S214. In the present embodiment, the first transmitting unit 14L reads the discharge timing included in the processing information transmitted from the information processing apparatus 120 at Step S204. The first transmitting unit 14L then determines the timing from when the processing information is received from the information processing apparatus 120 at Step S204 to when the read discharge timing passes.

If the first transmitting unit 14L determines the discharge timing, the first transmitting unit 14L transmits a post-processing start signal to the post-processing apparatus 18 (Step S220).

In the control unit 18A of the post-processing apparatus 18, the post-processing control unit 18C receives the post-processing start signal. The post-processing control unit 18C controls the post-processing unit 18B so as to start the post-processing when receiving the post-processing start signal. The control causes the post-processing unit 18B to start the post-processing specified by the contents of post-processing transferred at Step S206 (Step S222).

If no recording medium is conveyed from the image forming apparatus 160 for a predetermined time or longer, the post-processing unit 18B transmits a processing completion signal indicating completion of the post-processing to the control processing unit 140A of the control apparatus 140 (Step S224).

The control processing unit 140A that receives the processing completion signal transmits processing completion notification indicating completion of the processing to the information processing apparatus 120 (Step S226). By contrast, if the image forming apparatus 160 that starts the image formation processing at Step S214 completes formation of all the images in the image data specified by the image formation information included in the print data transmitted from the information processing apparatus 120, the image forming apparatus 160 transmits print completion notification indicating completion of the image formation to the information processing apparatus 120 (Step S228).

If the print completion notification is received from the image forming apparatus 160 and the processing completion notification is received from the control apparatus 140, the main control unit 12B of the information processing apparatus 120 completes the cooperation processing.

As described above, in the image forming system 10A according to the present embodiment, the information processing apparatus 120 calculates the discharge timing and transmits the discharge timing to the control apparatus 140. The acquiring unit 140E of the control apparatus 140 acquires the discharge timing included in the processing information received from the information processing apparatus 120. The first transmitting unit 14L then transmits the post-processing start signal corresponding to the discharge timing to the post-processing apparatus 18.

This enables the image forming unit 16B and the post-processing unit 18B to operate in conjunction with each other similarly to the first embodiment without any sensor to detect that the recording medium reaches the discharge area 17 in the image forming apparatus 160.

Third Embodiment

In an image forming system according to a third embodiment, a control apparatus calculates the discharge timing described above.

Figure 6:
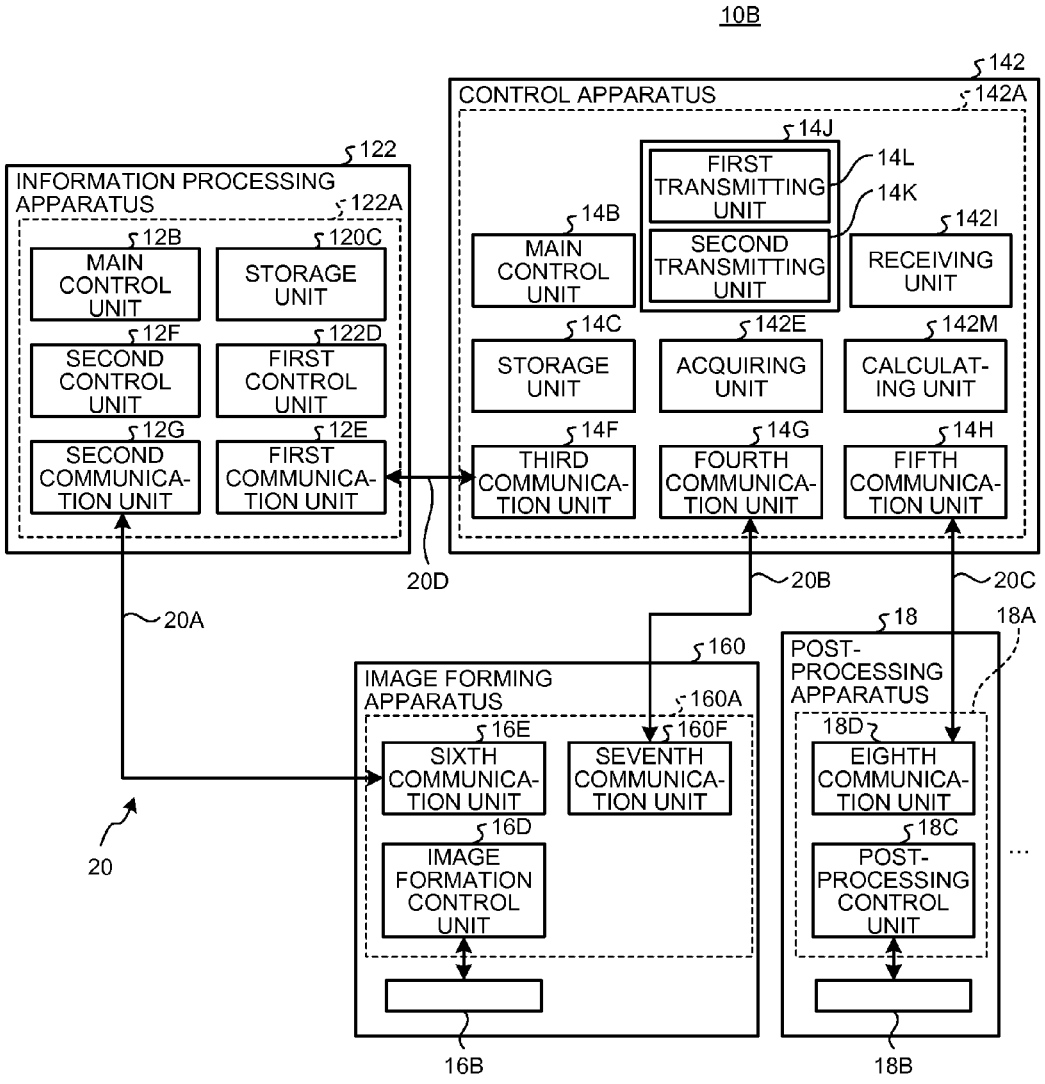
FIG. 6 is a functional block diagram of an image forming system according to a third embodiment of the present invention.

FIG. 6 is a functional block diagram of an image forming system 10B according to the present embodiment. In the image forming system 10B according to the present embodiment, an information processing apparatus 122, a control apparatus 142, an image forming apparatus 160, and a post-processing apparatus 18 are connected via a communication unit 20. The post-processing apparatus 18 and the communication unit 20 are the same as those in the first embodiment. The image forming apparatus 160 is the same as that in the second embodiment.

The information processing apparatus 122 and the control apparatus 142 are connected via a communication unit 20D. The control apparatus 142 is connected to the image forming apparatus 160 via a communication unit 20B and to the post-processing apparatus 18 via a communication unit 20C. The information processing apparatus 122 and the image forming apparatus 160 are connected via a communication unit 20A.

The information processing apparatus 122 includes an information processing unit 122A that controls the information processing apparatus 122. The information processing unit 122A includes a main control unit 12B, a storage unit 120C, a first control unit 122D, a first communication unit 12E, a second control unit 12F, and a second communication unit 12G. The function and the configuration of the main control unit 12B, the first communication unit 12E, the second control unit 12F, and the second communication unit 12G are the same as those in the first embodiment. The storage unit 120C stores therein processing capability information of the image forming apparatus 160 in advance similarly to the second embodiment.

The main control unit 12B, the storage unit 120C, the first control unit 122D, the first communication unit 12E, the second control unit 12F, and the second communication unit 12G may be implemented by a processor such as a CPU executing a computer program, that is, by software, by hardware such as an IC, or by a combination of software and hardware.

The first control unit 122D controls the control apparatus 142. In the case of the first control unit 122D being implemented by software, the first control unit 122D is implemented by the processor such as a CPU executing driver software that connects to the control apparatus 142 and controls the control apparatus 142. In the present embodiment, the first control unit 122D transmits processing information including the processing capability information stored in the storage unit 120C, the contents of post-processing, and image formation information on formation of an image to be formed by the image forming apparatus 160 to the control apparatus 142 via the first communication unit 12E and the communication unit 20D.

A control processing unit 142A of the control apparatus 142 includes a main control unit 14B, a storage unit 14C, an acquiring unit 142E, a calculating unit 142M, a third communication unit 14F, a fourth communication unit 14G, a fifth communication unit 14H, a receiving unit 142I, and a transmitting unit 14J. The main control unit 14B, the storage unit 14C, the acquiring unit 142E, the calculating unit 142M, the third communication unit 14F, the fourth communication unit 14G, the fifth communication unit 14H, the receiving unit 142I, and the transmitting unit 14J may be implemented by a processor such as a CPU executing a computer program, that is, by software, by hardware such as an IC, or by a combination of software and hardware. The main control unit 14B, the storage unit 14C, the third communication unit 14F, the fourth communication unit 14G, the fifth communication unit 14H, and the transmitting unit 14J are the same as those in the first embodiment.

The receiving unit 142I receives the processing information including the contents of post-processing to be performed by a post-processing unit 18B of the post-processing apparatus 18, the processing capability information of the image forming apparatus 160, and the image formation information from the information processing apparatus 122.

The calculating unit 142M calculates a discharge timing using the processing capability information and the image formation information included in the processing information received from the information processing apparatus 122. The calculating unit 142M calculates the discharge timing in the same manner as that of the calculating unit 120H according to the second embodiment.

The processing capability information may be stored in advance in the storage unit 14C. In this case, the first control unit 122D of the information processing apparatus 122 simply needs to transmit processing information including the image formation information and the contents of post-processing to the control apparatus 142. The receiving unit 142I of the control apparatus 142 receives the processing information. The calculating unit 142M calculates the discharge timing using the processing capability information stored in the storage unit 14C and the image formation information included in the processing information received by the receiving unit 142I.

The acquiring unit 142E acquires the discharge timing calculated by the calculating unit 142M.

Figure 7:
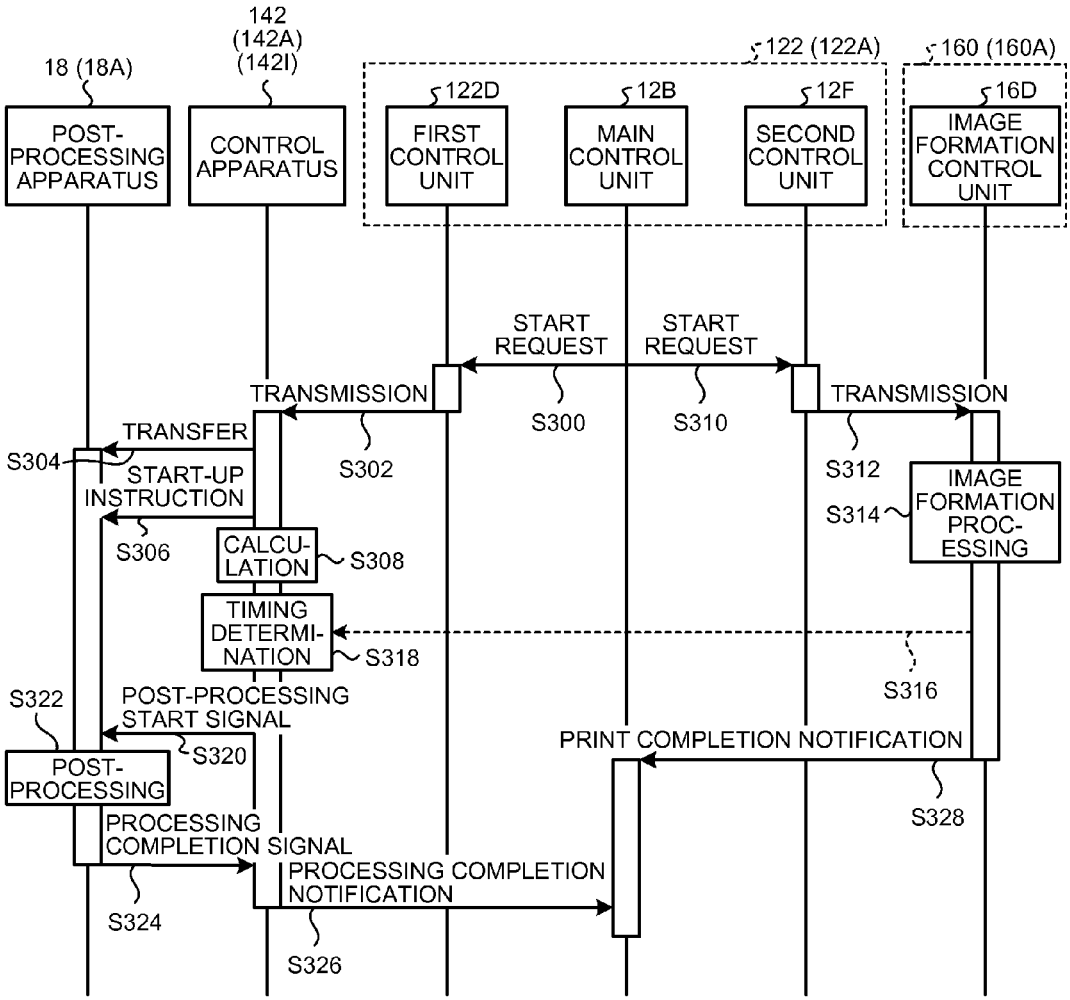
FIG. 7 is a sequence diagram of an example of cooperation processing performed in the image forming system according to the third embodiment.

The following describes a sequence of cooperation processing performed by the image forming system 10B, so as to cause the mage forming apparatus 16 and the post-processing apparatus 18 to operate (i.e., "cooperate") in conjunction with each other. FIG. 7 is a sequence diagram of an example of the cooperation processing performed in the image forming system 10B.

The main control unit 12B of the information processing unit 122A transmits a start request indicating start of processing to the first control unit 122D and the second control unit 12F (Step S300 and Step S310). The start request is the same as that in the first embodiment.

The first control unit 122D that receives the start request from the main control unit 12B transmits processing information including the contents of post-processing of the post-processing apparatus 18, image formation information on formation of an image to be formed by the image forming apparatus 160, and processing capability information of the image forming apparatus 160 to the control apparatus 142 (control processing unit 142A) (Step S302).

In the control processing unit 142A, the receiving unit 142I receives the processing information, and a second transmitting unit 14K transfers the processing information to the post-processing apparatus 18 (Step S304). In a control unit 18A of the post-processing apparatus 18, a post-processing control unit 18C receives the processing information. The post-processing control unit 18C makes various types of initial settings and the like such that the post-processing unit 18B can perform the post-processing specified by the contents of processing included in the received processing information.

Subsequently, the transmitting unit 14J of the control processing unit 142A transmits a start-up instruction for bringing the post-processing apparatus 18 into a standby state capable of starting the post-processing to the post-processing apparatus 18 (Step S306). In the control unit 18A of the post-processing apparatus 18, the post-processing control unit 18C receives the start-up instruction. The post-processing control unit 18C that receives the start-up instruction brings the post-processing unit 18B into a standby state such that the post-processing unit 18B can start the post-processing when receiving the next post-processing start signal.

The calculating unit 142M calculates a discharge timing from the image formation information and the processing capability information included in the processing information transmitted from the information processing apparatus 122 at Step S302 (Step S308). By contrast, when the main control unit 12B transmits the start request to the second control unit 12F at Step S310, the second control unit 12F that receives the start request transmits print data including the image formation information to the image forming apparatus 160 (Step S312).

In a control unit 160A of the image forming apparatus 160, an image formation control unit 16D receives the print data. The image formation control unit 16D that receives the print data performs image formation processing (Step S314). The processing at Step S314 is the same as the image formation processing in the first embodiment (refer to Step S114 in FIG. 3).

Subsequently, a first transmitting unit 14L of the control processing unit 142A determines a discharge timing (Step S318). The first transmitting unit 14L determines a timing (Step S316) at which a recording medium on which the image is formed by an image forming unit 16B is conveyed to a discharge area 17 in the image formation processing at Step S314. In the present embodiment, the first transmitting unit 14L reads the discharge timing calculated by the calculating unit 142M at Step S308. The first transmitting unit 14L then determines the timing from when the processing information is received from the information processing apparatus 122 at Step S302 to when the read discharge timing passes.

If the first transmitting unit 14L determines the discharge timing, the first transmitting unit 14L transmits a post-processing start signal to the post-processing apparatus 18 (Step S320).

In the control unit 18A of the post-processing apparatus 18, the post-processing control unit 18C receives the post-processing start signal. The post-processing control unit 18C controls the post-processing unit 18B so as to start the post-processing when receiving the post-processing start signal. The control causes the post-processing unit 18B to start the post-processing specified by the contents of post-processing transferred at Step S304 (Step S322).

If no recording medium is conveyed from the image forming apparatus 160 for a predetermined time or longer, the post-processing unit 18B transmits a processing completion signal indicating completion of the post-processing to the control processing unit 142A of the control apparatus 142 (Step S324).

The control processing unit 142A that receives the processing completion signal transmits processing completion notification indicating completion of the processing to the information processing apparatus 122 (Step S326). By contrast, if the image forming apparatus 160 that starts the image formation processing at Step S314 completes formation of all the images in the image data specified by the image formation information included in the print data transmitted from the information processing apparatus 122, the image forming apparatus 160 transmits print completion notification indicating completion of the image formation to the information processing apparatus 122 (Step S328).

If the print completion notification is received from the image forming apparatus 160 and the processing completion notification is received from the control apparatus 142, the main control unit 12B of the information processing apparatus 122 completes the cooperation processing.

As described above, in the image forming system 10B according to the present embodiment, the calculating unit 142M of the control apparatus 142 calculates the discharge timing. The acquiring unit 142E of the control apparatus 142 acquires the discharge timing from the calculating unit 142M. The first transmitting unit 14L then transmits the post-processing start signal corresponding to the discharge timing to the post-processing apparatus 18.

This enables the image forming unit 16B and the post-processing unit 18B to operate in conjunction with each other similarly to the first embodiment without any sensor to detect that the recording medium reaches the discharge area 17 in the image forming apparatus 160.

Second Modification

In the embodiments above, the image forming systems 10, 10A, and 10B each include one post-processing apparatus 18 at the side for discharging the recording medium of the image forming apparatuses 16 and 160. Alternatively, the image forming systems 10, 10A, and 10B may each include a plurality of post-processing apparatuses 18. In this case, the post-processing apparatuses 18 are arranged in order of performing processing on the recording medium. The control apparatuses 14, 140, and 142 calculates transmission timings to transmit the post-processing start signal to the respective post-processing apparatuses 18 based on the discharge timing corresponding to the detection signal transmitted from the detecting unit 16C provided to the image forming apparatus 16 and on the discharge timing calculated by the calculating unit 120H of the information processing apparatuses 12, 120, and 122 or the calculating unit 142M of the control apparatuses 14, 140, and 142. The control apparatuses 14, 140, and 142 transmit the post-processing start signal to each of the post-processing apparatuses 18 corresponding thereto at the transmission timings calculated for the respective post-processing apparatuses 18. The transmission timings to transmit the post-processing start signal to the respective post-processing apparatuses 18 are calculated so as to be each synchronized with the timing at which the recording medium is conveyed to the position of the post-processing apparatus 18 based on the processing capability and the arrangement of the post-processing apparatus 18.

Third Modification

Figure 8:
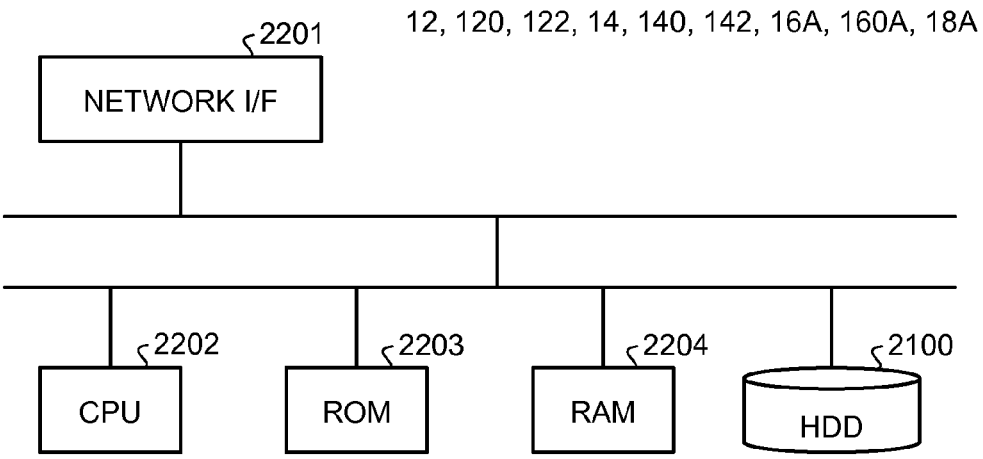
FIG. 8 is a block diagram of an exemplary hardware configuration of information processing units, control processing units, and control units.

The following describes the hardware configuration of the information processing units 12A, 120A, and 122A, the control processing units 14A, 140A, and 142A, the control units 16A and 160A, and the control unit 18A according to the first to the third embodiments. FIG. 8 is a block diagram of an exemplary hardware configuration of the information processing units 12A, 120A, and 122A, the control processing units 14A, 140A, and 142A, the control units 16A and 160A, and the control unit 18A.

The information processing units 12A, 120A, and 122A, the control processing units 14A, 140A, and 142A, the control units 16A and 160A, and the control unit 18A each mainly include a CPU 2202, a storage device such as a ROM 2203 and a RAM 2204, an external storage device such as a hard disk drive (HDD) 2100 and a compact disc (CD) drive (not illustrated), a display device (not illustrated) such as a display, an input device (not illustrated) such as a keyboard and a mouse, and a network interface (I/F) 2201. This is a hardware configuration using a typical computer.

The computer program for performing the cooperation processing executed in the information processing units 12A, 120A, and 122A, the control processing units 14A, 140A, and 142A, the control units 16A and 160A, and the control unit 18A is recorded and provided in a computer-readable recording medium such as a CD-ROM, a flexible disk (FD), a compact disc recordable (CD-R), and a digital versatile disc (DVD), as an installable or executable file.

The computer program for performing the cooperation processing executed in the information processing units 12A, 120A, and 122A, the control processing units 14A, 140A, and 142A, the control units 16A and 160A, and the control unit 18A may be stored in a computer connected to a network such as the Internet and provided by being downloaded via the network. Furthermore, the computer program for performing the cooperation processing executed in the information processing units 12A, 120A, and 122A, the control processing units 14A, 140A, and 142A, the control units 16A and 160A, and the control unit 18A may be provided or distributed via a network such as the Internet.

The computer program for performing the cooperation processing executed in the information processing units 12A, 120A, and 122A, the control processing units 14A, 140A, and 142A, the control units 16A and 160A, and the control unit 18A may be embedded and provided in the ROM 2203, for example.

The computer program for performing the cooperation processing executed in the information processing units 12A, 120A, and 122A, the control processing units 14A, 140A, and 142A, the control units 16A and 160A, and the control unit 18A has a module configuration including each unit described above (the main control unit, the storage unit, the second control unit, the first control unit, the second communication unit, the first communication unit, the acquiring unit, the receiving unit, the transmitting unit, the first transmitting unit, the second transmitting unit, the calculating unit, the third communication unit, the fourth communication unit, the fifth communication unit, the sixth communication unit, the seventh communication unit, the image formation control unit, the eighth communication unit, and the post-processing control unit). In actual hardware, the CPU reads and executes the computer program from the storage medium described above to load each unit on the main memory such as the RAM 2204. Thus, each unit is generated on the main memory.

The present invention enables an image forming unit and a post-processing unit to operate in conjunction with each other.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming system comprising:

an image forming unit that forms an image on a recording medium;

a post-processing unit adjacent to the image forming unit that performs predetermined post-processing on the recording medium;

an acquiring unit that acquires a discharge timing from the image forming unit based on a detection of conveyance of the recording medium from the image forming unit to the post-processing unit;

a transmitting unit that transmits a post-processing start signal corresponding to the discharge timing; and a post-processing control unit that causes the post-processing unit to start the post-processing when receiving the post-processing start signal from the transmitting unit.

2. The image forming system according to claim 1, further comprising:

a detecting unit that detects the conveyance of the recording medium from the image forming unit to the post-processing unit, and transmits the discharge timing to the acquiring unit based on the detection.

3. The image forming system according to claim 1, further comprising:

a calculating unit that calculates the discharge timing, wherein the acquiring unit acquires the calculated discharge timing.

4. The image forming system according to claim 1, further comprising:

an information processing unit that stores print data and post-processing data; and a control apparatus that receives the post-processing data from the information processing unit;

wherein the image forming unit that receives the print data from the information processing unit, and forms the image on the recording medium based on the print data; and wherein the control apparatus includes the acquiring unit and the transmitting unit.

5. The image forming system according to claim 4, wherein:

the post-processing unit receives the-post-processing data from the control apparatus, establishes settings for performing post-processing based on the post-processing data, and enters a standby state after the settings are established;

the control apparatus releases the standby state of the post-processing unit in response to receiving the discharge timing, and causes the post-processing unit to start performing post-processing based on the post-processing data.

6. The image forming system according to claim 5, wherein:

the post-processing data includes at least one of a size of the recording medium, a type of post-processing to be performed by the post post-processing unit, or some combination thereof.

7. A control apparatus comprising:

a receiving unit that receives processing information including a content of post-processing of a post-processing apparatus that is provided at a side for discharging a recording medium of an image forming apparatus that forms an image on the recording medium and performs predetermined post-processing on the recording medium from an information processing apparatus connected via a communication unit;

an acquiring unit that acquires, from the image forming apparatus connected via a communication unit, a discharge timing at which the recording medium is discharged from the image forming apparatus;

a second transmitting unit that transmits the processing information to the post-processing apparatus; and a first transmitting unit that transmits a post-processing start signal indicating start of post-processing to the post-processing apparatus when acquiring the discharge timing.

8. The control apparatus according to claim 7, wherein the acquiring unit acquires, from the image forming apparatus, a detection signal indicating that the recording medium is detected at a discharge area of the recording medium in the image forming apparatus as the discharge timing.

9. The control apparatus according to claim 7, wherein the acquiring unit acquires the discharge timing from the information processing apparatus.

10. The control apparatus according to claim 7, further comprising:

a calculating unit that calculates the discharge timing based on image formation information on formation of an image to be formed by the image forming apparatus and processing capability information indicating processing capability of the image forming apparatus, wherein the acquiring unit acquires the calculated discharge timing.

11. A control method comprising:

acquiring a discharge timing at which a recording medium is discharged from an image forming unit that forms an image on the recording medium to a post-processing unit that is adjacent to the image forming unit and which performs predetermined post-processing on the recording medium;

acquiring the discharge timing at which the recording medium is discharged from the image forming unit and transmitting a post-processing start signal corresponding to the discharge timing; and causing the post-processing unit to start the post-processing when receiving the post-processing start signal.

* * * * *